United States Patent [19]

Meier

[11] 4,050,199

[45] Sept. 27, 1977

[54] METHOD OF GRINDING A TOOTHED CUTTER FOR HAIR-CUTTING APPARATUS

[75] Inventor: Otto Meier, Klagenfurt, Austria

[73] Assignee: U.S. Philips Corporation, New York, N.Y.

[21] Appl. No.: 679,804

[22] Filed: Apr. 23, 1976

[30] Foreign Application Priority Data

Apr. 28, 1975 Austria ..... 3279/75

[51] Int. Cl.[2] ..... B24B 1/00

[52] U.S. Cl. ..... 51/285; 51/327; 76/104 R; 76/DIG. 9

[58] Field of Search ..... 30/346.51; 51/74 BS, 51/77 BS, 91 BS, 92 BS, 98 BS, 109 BS, 285, 34 R, 327; 76/104 R, DIG. 9, 82

[56] References Cited

U.S. PATENT DOCUMENTS

| | | | |
|---|---|---|---|
| 2,151,965 | 3/1939 | Hanley | 30/346.51 |
| 2,791,073 | 5/1957 | Grum-Schwensen | 51/285 |
| 2,865,140 | 12/1958 | Shumway | 51/285 X |
| 3,631,641 | 1/1972 | Scholin | 51/285 |
| 3,800,417 | 4/1974 | Tietjens | 30/346.51 |
| 3,879,899 | 4/1975 | Ribar | 51/92 BS |

*Primary Examiner*—Gary L. Smith

*Attorney, Agent, or Firm*—Frank R. Trifari; Rolf E. Schneider

[57] ABSTRACT

A method of grinding a toothed cutter for hair-cutting apparatus, the cutter having at least one strip-shaped row of cutting teeth, comprises pressing the entire row into engagement with the circumferential surface of a rotating grinding shaft while longitudinally orienting such row of cutting teeth parallel to the axis of the grinding shaft.

3 Claims, 1 Drawing Figure

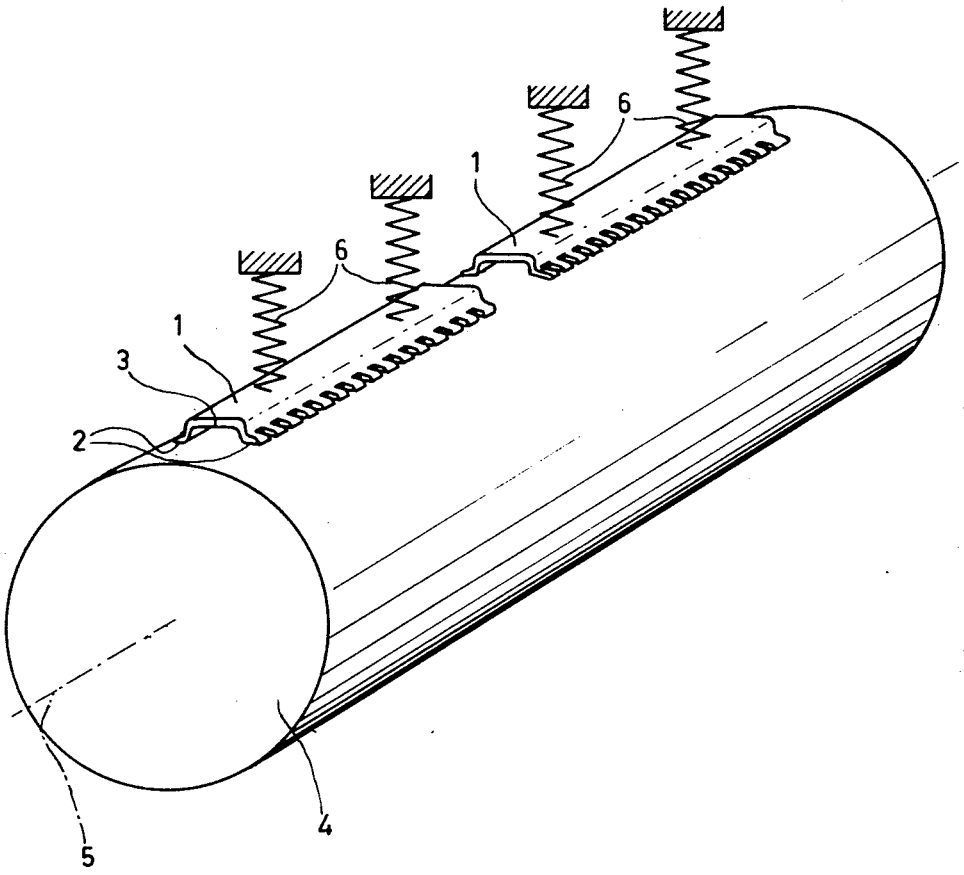
6
1
6
1
3
2
4
5

METHOD OF GRINDING A TOOTHED CUTTER FOR HAIR-CUTTING APPARATUS

This invention relates to a method of grinding a toothed cutter for hair cutting apparatus, in particular dry-shaving apparatus, the cutter having at least one strip-shaped row of cutting teeth extending in its longitudinal direction.

A prior-art method of this type employs a grinding disc which is moved over the row of cutting teeth with its axis of rotation intersecting the row of cutting teeth, the individual teeth being machined consecutively. As the tooth thickness, viewed in a direction perpendicular to its cutting surface, is generally very small, the motion of the grinding disc results in the individual teeth being twisted, the degree of twisting increasing from the tooth root towards the free tooth end. As a result, the cutting surfaces of the several teeth will exhibit a curvature viewed in the longitudinal direction of the row of cutting teeth, and consequently the tooth edges will be more or less rounded. Because the tooth edges contribute essentially to the cutting process, such rounding results in poor cutting action, since a gap is formed between the engaging tooth edges during co-operation with a counter toothed cutter.

Furthermore, it has been found that during such grinding of the teeth generally somewhat more stock is removed from the free tooth ends that from the tooth roots, so that viewed in this direction the cutting surface also becomes curved, with the result that during cooperation with a counter-cutter a gap is also formed at the location of the free tooth ends, which also adversely affects the cutting action.

It is the object of the invention to avoid these problems and this is achieved in that over the entire cutting surface of the row of cutting teeth to be ground the cutter is pressed into engagement with the circumferential surface of a rotating grinding shaft, whose diameter is great relative to the length of the teeth to be ground, the longitudinal direction of the row of cutting teeth being oriented parallel to the axis of the grinding shaft.

Thus, all the teeth are ground simultaneously from the tooth root towards the free tooth end or in the opposite direction, without the individual teeth being twisted, so that tooth edges having exact cutting surfaces are obtained. Furthermore, viewed in the longitudinal direction of the teeth slightly curved cutting surfaces result, owing to the curved surface of the grinding shaft, somewhat more stock being removed at the tooth root than at the free tooth end, so that the risk that at the free tooth end more stock is removed than at the tooth root is mitigated.

The grinding method in accordance with the invention thus provides cutting surfaces with which the teeth of a counter-cutter can engage in a perfectly exact manner, viewed in all directions, with no undesired gaps and thus a very good cutting action is obtained.

It is advantageous with regard to the form of the cutting surfaces, if during the grinding process the direction of rotation of the grinding shaft is reversed at least one time. It is further advantageous when the cutter is moved to and fro slowly in comparison with the circumferential speed of the shaft in the axial direction of the grinding shaft, so that a uniform wear of the grinding shaft is assured, which also promotes the formation of accurate cutting surfaces.

The invention will be described in more detail with reference to the drawing, which schematically shows as embodiment to which the invention is not limited.

In the present example the cutters 1 to be ground, which are for example destined for dry-shaving apparatus, each have two strip-shaped rows 2 of cutting teeth, which extend in the longitudinal direction of the cutters. The rows 2 of cutting teeth project sideways from a substantially U-shaped central portion 3 of each cutter 1.

The grinding shaft 4 is rotated about its axis 5. The diameter of the grinding shaft is selected great relative to the tooth length to be ground; its diameter is for example approximately 5 cm in the case of a tooth length of approximately2 mm. Thus, viewed in a row of longitudinal direction of the teeth, a cutting surface is obtained on each tooth which is slightly curved from the tooth roots towards the free tooth ends, slightly more stock being removed at the tooth roots than at the free tooth ends, thereby eliminating the unfavourable, opposite case in which at the free tooth ends more stock is removed than at the tooth roots. Thus, a ground cutter is obtained which ensures a very snug, precise engagement with a counter-cutter.

For grinding the rows 2 of cutting teeth the cutters 1 are positioned on the circumferential surface of the grinding shaft 4 along the entire cutting surface to be ground, with the longitudinal direction of the row of cutting teeth parallel to the axis 5 of the grinding shaft. Thus, all the teeth are ground simultaneously from the tooth root towards the free tooth end, or in the opposite direction. It is obvious that for retaining the cutter 1 and for bringing said cutter into engagement with the grinding shaft 4 a device is provided, which is not shown for the sake of simplicity. Suitably, the cutters 1 are then simply pressed onto the grinding shaft 4 under the influence of springs 6. In the present embodiment, as is shown in the drawing, two cutters are ground at the same time; it is evident that also more than two cutters may be ground at the same time, if the grinding shaft is correspondingly long, or that cutters may be positioned simultaneously at several mutually different angular positions on the circumferential surface of the grinding shaft.

In the present grinding process the teeth are not subjected to a load which could give rise to twisting of said teeth, because the teeth are ground from the tooth root towards the free tooth end, or in the opposite direction. Thus, the cutting surfaces of the teeth are ground exactly up to the tooth edges, yielding sharp, non-rounded tooth edges. If during use such a cutter co-operates with a corresponding counter-cutter, no gap is formed at the engaging tooth edges, so that hairs are cut precisely and reliably. Furthermore, the advantage is obtained that the grooves which are normally formed during grinding extend in the longitudinal direction of the teeth from the tooth root towards the free tooth end and are consequently not located adjacent the tooth edges, whereby these are not impaired.

In the grinding method according to the invention the direction of rotation of the grinding shaft is preferably reversed at least once during a grinding operation. Thus, the teeth are ground both in the direction from the tooth root towards the free tooth end and in the opposite direction, which is also found to be favourable with regard to the formation of a precise cutting surface. Furthermore, the device which carries the cutters, is preferably moved to and fro slowly in comparison with the circumferential speed of the shaft in the direction of the axis 5 of the grinding shaft, ensuring a uniform wear of the grinding shaft. The speed with which this to and fro movement is performed should be selected so low relative to the circumferential speed of the grinding shaft, that the above-mentioned grooves make only a small angle with the longitudinal direction of the teeth. In the present embodiment this speed may for example be approximately one hundredth of the circumferential speed of the grinding shaft, which is effectively of the order of magnitude of 8 m/sec.

In the present embodiment the cutters engage the grinding shaft with both rows of cutting teeth owing to their special form, so that a particularly positive engagement of the surfaces to be ground by the grinding shaft is obtained. However, it is evident that cutters with only one row of cutting teeth may also be ground in accordance with the present method without taking further steps, in which case the device which holds the cutters should merely be designed so that a positive engagement of the cutting surface with the grinding shaft is assured.

What is claimed is:

1. A method of grinding a toothed cutter for hair-cutting apparatus such as dry-shaving apparatus, said toothed cutter having a pair of longitudinally extending strip-shaped rows of cutting teeth, which comprises simultaneously pressing both entire rows of cutting teeth of the toothed cutter into engagement with the circumferential surface of a rotating grinding shaft, the diameter of said grinding shaft being great relative to the length of the individual teeth being ground, while longitudinally orienting said rows of cutting teeth parallel to the axis of the grinding shaft.

2. A method according to claim 1, which includes reversing the direction of rotation of the grinding shaft at least once during the grinding of the toothed cutter.

3. A method according to claim 1, which includes moving the toothed cutter to and fro axially of the grinding shaft relatively slowly with respect to the circumferential speed of said grinding shaft.

* * * * *

UNITED STATES PATENT AND TRADEMARK OFFICE

CERTIFICATE OF CORRECTION

PATENT NO. : 4050199

DATED : Sept. 27, 1977

INVENTOR(S) : OTTO MEIER

It is certified that error appears in the above–identified patent and that said Letters Patent are hereby corrected as shown below:

Column 1, line 29, "that" should be --than--

Column 2, lines 15 and 16, after "2 mm." it should read

--Thus, viewed in the longitudinal direction of a row of teeth, a cutting surface is--

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*